United States Patent [19]

Nagasawa

[11] 4,064,849

[45] Dec. 27, 1977

[54] INTERNAL COMBUSTION ENGINE

[75] Inventor: Takashi Nagasawa, Miura, Japan

[73] Assignee: Nissan Motor Co., Ltd., Yokohama, Japan

[21] Appl. No.: 541,105

[22] Filed: Jan. 15, 1975

[30] Foreign Application Priority Data

Jan. 17, 1974 Japan ..... 49-8243

[51] Int. Cl.[2] ..... F02B 17/00; F01L 3/22

[52] U.S. Cl. ..... 123/75 B; 123/188 M; 123/188 S

[58] Field of Search ..... 123/75 B, 79 C, 32 ST, 123/32 SA, 188 M, 188 S

[56] References Cited

U.S. PATENT DOCUMENTS

| | | | |
|---|---|---|---|
| 1,245,511 | 11/1917 | Riotte | 123/75 B |
| 1,456,655 | 5/1923 | Thomas | 123/75 B |
| 1,644,029 | 10/1927 | Porsche | 123/119 C |
| 2,011,993 | 8/1935 | Aseltine | 123/75 B |
| 2,799,257 | 7/1957 | Stumpfig et al. | 123/32 SP |
| 3,678,905 | 7/1972 | Diehl | 123/75 B X |
| 3,911,873 | 10/1975 | Dave | 123/188 M X |

FOREIGN PATENT DOCUMENTS

| | | | |
|---|---|---|---|
| 237,637 | 8/1911 | Germany | 123/75 B |
| 939,780 | 3/1956 | Germany | 123/188 S |

*Primary Examiner*—Carroll B. Dority, Jr.
*Assistant Examiner*—Tony M. Argenbright

[57] ABSTRACT

Intake arrangement of an internal combustion engine comprises an air intake passageway and an air-fuel mixture intake passageway with its port arranged radially inwardly of the air intake passageway. Port opening period of the air-fuel mixture intake port is full overlapped with and shorter than port opening period of air intake port of the air intake passageway.

3 Claims, 13 Drawing Figures

Figures 1A, 1B, 1C:
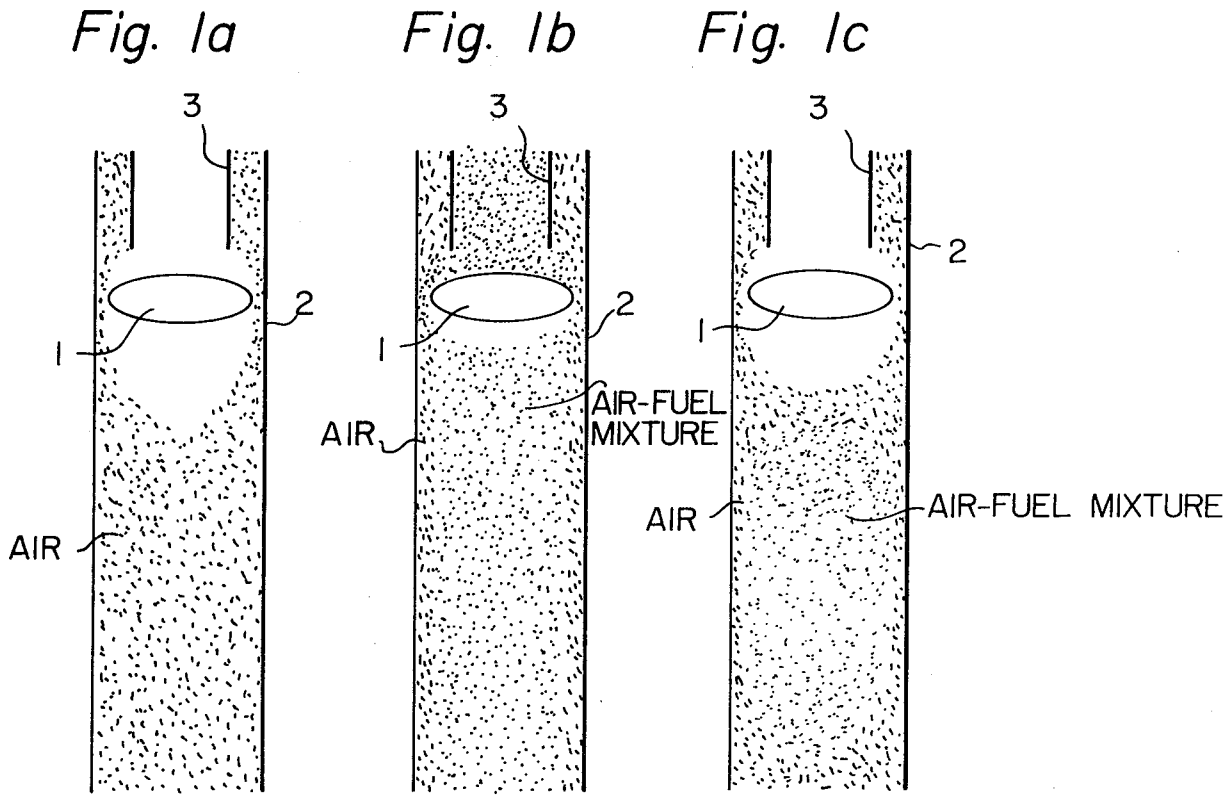

1
2
3
AIR
AIR-FUEL MIXTURE
AIR-FUEL MIXTURE

INTERNAL COMBUSTION ENGINE

The present invention relates to an internal combustion engine, and more particularly to improvements in an internal combustion engine.

It is well known that fuel film that has reached the combustion chamber walls is hardly burned off because combustion flame tends to go off upon coming into contact with the chamber walls that are forcibly cooled and issued as hydrocarbons from the engine. Some hydrocarbons, however, remain as deposit on the combustion walls, and due to this deposit cooling efficiency of the combustion walls decreases and engine lubricating oil becomes dirty.

To reduce thickness of fuel film that has reached combustion chamber walls it has been suggested to increase the temperature of the combustion walls in order to facilitate vaporization of fuel film. This approach, however, has a limitation because the temperature that the chamber walls can resist will not be made sufficiently high for complete evaporation of the fuel film. Another approach is to form turbulences in air-fuel mixture charge to create higher temperature gradient near the combustion walls. However even with this approach it is impossible to completely burn off fuel film that has reached the chamber walls.

It is therefore an important object of the present invention to provide a stratified internal combustion engine in which air film forms within an area disposed adjacent combustion chamber walls and fuel is prevented from coming into contact with the chamber walls accordingly.

It is a further object of the present invention to provide a stratified internal combustion engine in which during the intake stroke of each cycle air film forms within an area disposed adjacent the combustion chamber walls and air-fuel mixture is embraced by the air film, being prevented from coming into contact with the chamber walls.

A still further object of the present invention is to provide a stratified internal combustion engine in which during the exhaust stroke of each cycle exhaust gas issued from the combustion chamber is imparted a stirring action as it enters exhaust passageway so that oxygen and unburned or partly burned will be mixed with each other to effect after burning in the exhaust passageway.

Figure 2B:
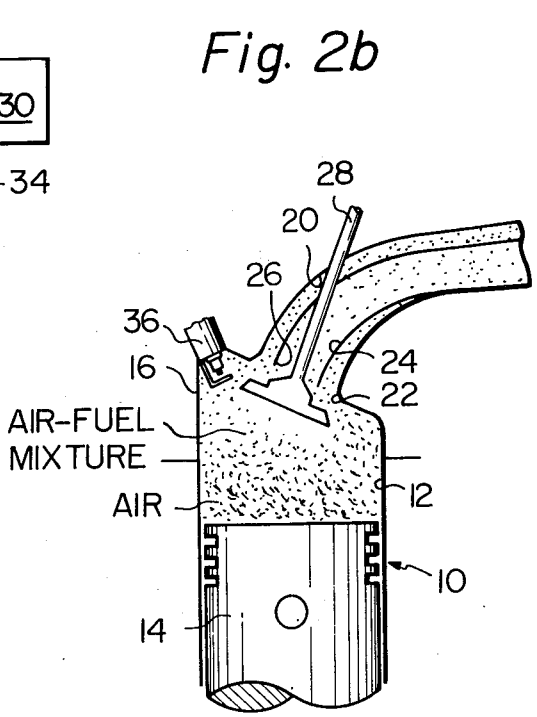
Figure 2A:
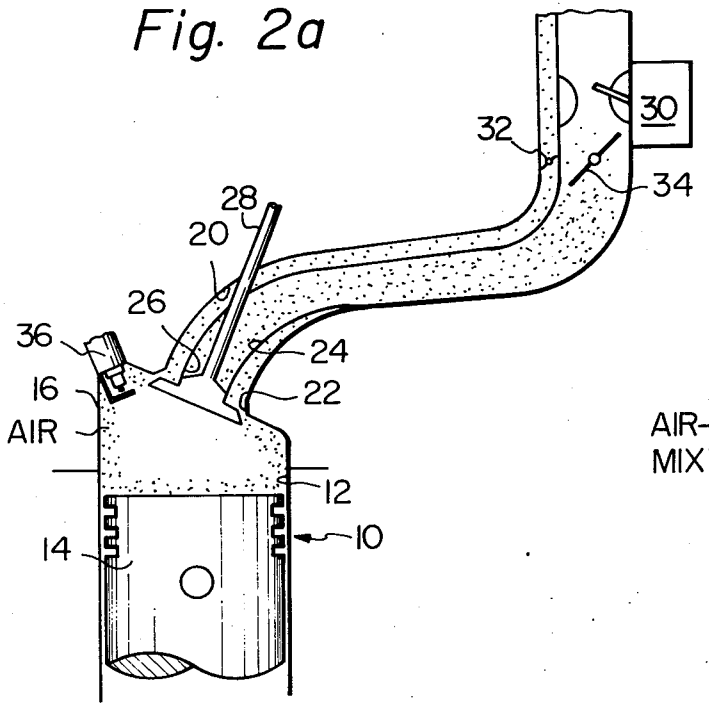
Figure 2D:
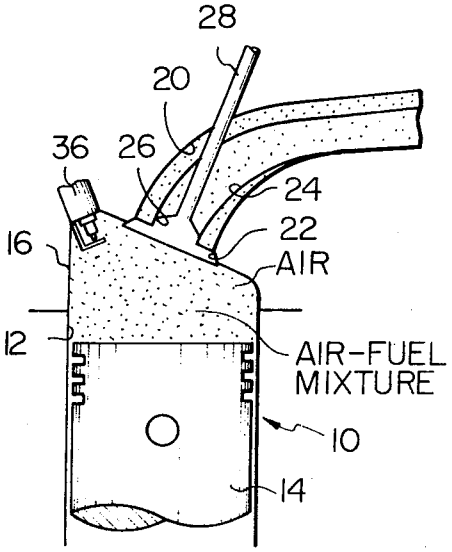
Figure 3C:
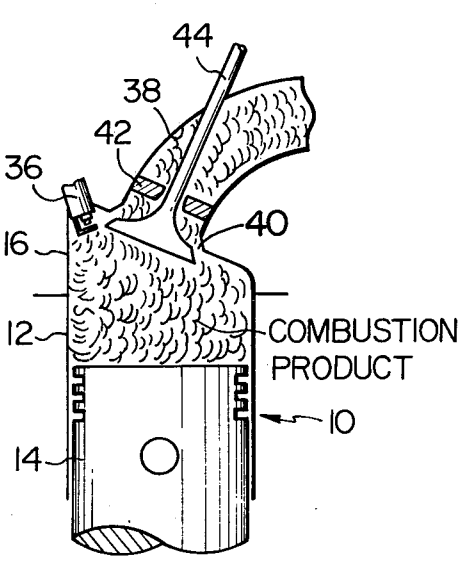
Figure 3B:
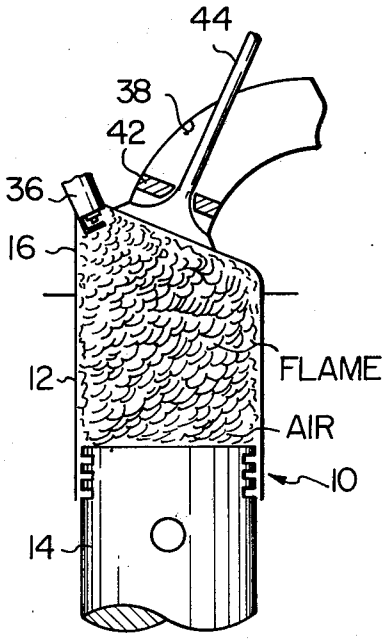
Figure 3A:
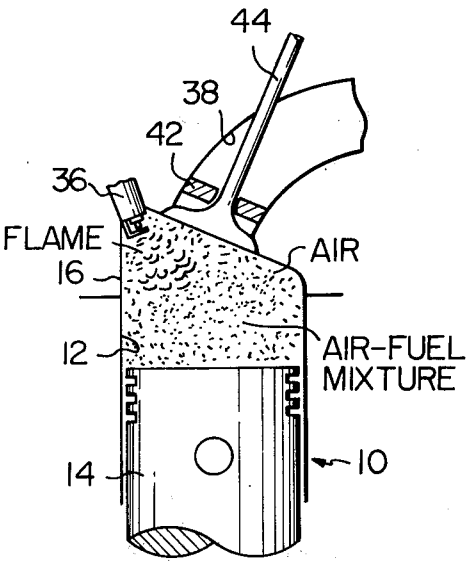
Figure 4C:
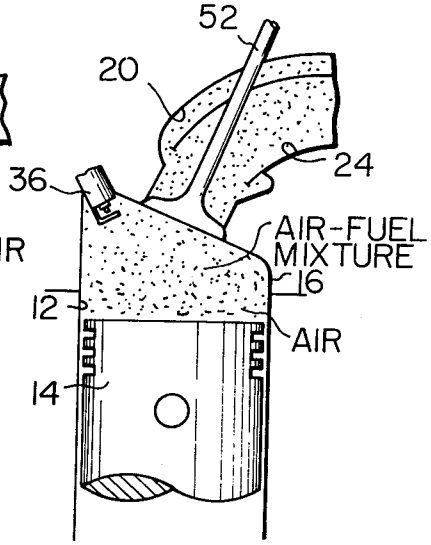
Figure 4B:
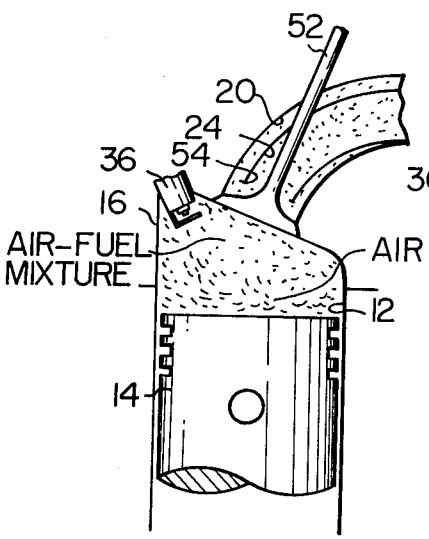
Figure 4A:
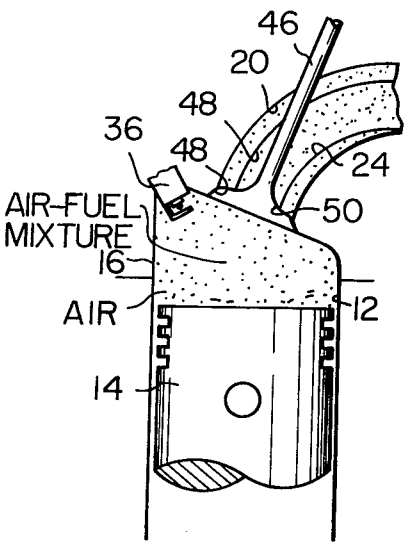

Other and further objects, features and advantages of the present invention will be apparent from the following description, taken in conjunction with the accompanying drawings, where like reference numerals designate like parts throughout the several views and wherein:

FIGS. 1*a* through 1*c* are diagrammatic view showing the effect of disposition of a disk in an annular air flow longitudinally along pipe inner wall, the effect of disposition of the disk in an air-fuel mixture pipe flow and the annular air flow, and the effect of the disk when the air-fuel mixture pipe flow is permitted for a limited period, respectively;

FIGS. 2*a* through 2*d* are diagrammatic views showing four different piston positions of a stratified internal combustion engine according to the present invention;

FIGS. 3*a* through 3*c* are diagrammatic views showing three different piston positions that occur subsequently to the piston position of FIG. 2*d;* and FIGS. 4*a* through 4*c* are diagrammatic views similar to FIG. 2*d* showing three modified arrangements of air and air-fuel mixture intakes.

As will be observed from FIG. 1*a,* if a disk 1 is disposed in a pipe 2 to interfere with an annular air flow along the pipe inner wall (flow is from top to bottom), the flow behind the disk 1 is a flow directed inwardly from the pipe inner wall. As shown in FIG. 1*b,* if air-fuel mixture flows along a small pipe 3 which is concentrically arranged within the large pipe 2 above the disk 1, air-fuel mixture flow behind the disk 1 is disposed radially inwardly of and surrounded by the air flow adjacent the pipe inner wall. Now let air-fuel mixture flow along the small pipe 3 for a limited period it is observed that air-fuel mixture cloud is completely embraced by air cloud as shown in FIG. 1*c.* The present invention is based on the above-mentioned recognition and contemplates to utilize it in an induction of a stratified internal combustion engine.

Referring particularly to FIG. 2*a,* the reference numeral 10 generally indicates a cylinder of a stratified internal combustion engine of the present invention and includes as is conventional a cylinder 12, a reciprocating piston 14 therein, a cylinder head 16 connected to the cylinder 12 with the cylinder, piston and cylinder head forming a combustion chamber 18.

To form an air cloud within the area adjacent the cylinder inner wall, piston head and cylinder head and an air-fuel mixture cloud in the central region of the combustion chamber 18, an air intake passageway 20 terminates in at an air intake port 22 in the interior wall of the cylinder head 16 and an air-fuel mixture intake passageway 24 terminates in at a combustible mixture intake port 26 disposed in the air intake passageway 20 radially inwardly of the air intake port 22, and both of these passageways 20 and 24 are valved by means of an intake valve 28 so that the opening period of the mixture intake port 26 starts after the air intake port 22 has been opened and ends before the air intake port 22 is closed. Connected to the air-fuel mixture passageway 24 is a conventional carburetor 30 and installed in the air intake passageway 20 is a throttle flap 32 which operates in cooperation with a carburetor throttle flap 34.

Figure 2C:
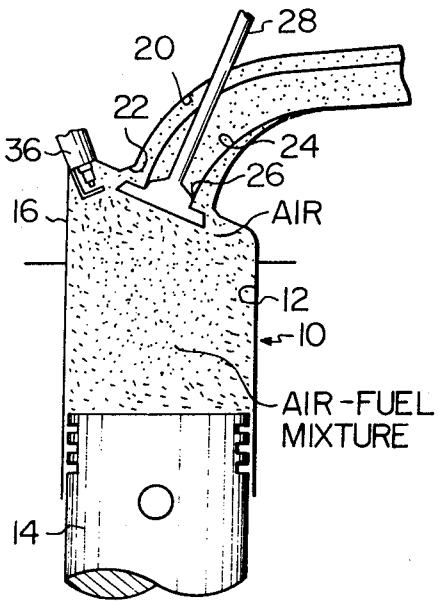

FIGS. 2*c* to 2*d* are diagrams of different piston positions during the intake stroke, showing the relation between the air intake port 22, mixture intake port 26 and intake valve 28. In the piston position of FIG. 2*a* or during the initial portion of the intake stroke the mixture intake port 26 remains closed but the air intake port 22 has been opened and air flows along the cylinder inner wall toward the piston head to form air cloud within area disposed adjacent the cylinder wall and piston head as indicated by primes in FIG. 2*a.* In the subsequent piston position of FIG. 1*b* or intermediate portion of the intake stroke, the air intake port 22 is also opened and air-fuel mixture flows radially inwardly of air flow as indicated by dots in FIG. 2*b.* In the piston position of FIG. 2*c* or the last portion of the intake stroke, the mixture intake port 26 is closed and only air flows into the cylinder through the air intake port 22 to form an air cloud within area disposed adjacent the interior wall of the cylinder head. During the compression stroke, as shown in FIG. 1*d,* the air intake port 22 as well as the mixture intake port 22 is closed by the intake valve 28. Since air-fuel mixture cloud is within area disposed in the center region of the combustion chamber 18 and embraced by an air cloud within area disposed adjacent the cylinder inner wall and cylinder head, a spark plug 36 should be arranged to project into the combustion chamber 18 relatively deeply.

Referring to FIGS. *3a* to *3c*, the reference numeral 38 indicates an exhaust passageway leading from an exhaust port 40 disposed in the cylinder head. A conventional stirring plate 42 (hereinafter referred to as a mixing plate) is disposed in the exhaust passageway 38 directly downstream of an exhaust valve 44. FIG. *3a* is a diagram of the combustion within the combustion chamber 46 and the position of the exhaust valve 44 during the expansion or combustion stroke of the engine. FIG. *3b* shows the last portion of the combustion stroke in which no unburnt fuel is formed within area disposed adjacent the cylinder inner wall, piston head and interior wall of the cylinder head under the effect of abundance of air in that area. FIG. *3c* shows an exhaust stroke of the engine. In the exhaust stroke air which did not make contribution to the combustion in the combustion chamber is mixed with CO and HC contents since the mixing plate 42 stirs exhaust gas issued from the combustion chamber 18 through the exhaust port 40. Consequently afterburning or oxidation of CO and HC contents in exhaust gas will occur in the exhaust passageway 38, since the temperature of exhaust gas directly after the exhaust port 40 is sufficiently high.

A complicated intake valve 28 has been utilized in the preceding engine to provide a shorter opening period of mixture intake port 26 (see FIGS. *2a* – *2d*). However, since an intake valve is complicated it tends to wear at a faster rate and consequently the long durability of an engine cannot be expected. Therefore, a more durable intake arrangement for providing the stratification of air and air-fuel mixture within a combustion chamber is shown in FIG. *4a*. An intake valve 46 shown in FIG. *4a* will be designed to simultaneously open and close both of an air intake port 48 and an air-fuel mixture intake port 50. An air intake passageway 20 is connected with a supercharger (not shown) so that air pressure in the intake passageway 20 is maintained high. Therefore during the initial and last portions of opening period of the intake valve 46 only air can flow into the cylinder due to its pressure and the air-fuel mixture cloud will be embraced by an air cloud within area disposed adjacent the cylinder wall, piston head and cylinder head 16 inner wall.

A modified arrangement shown in FIG. *4b* is different from the arrangement of FIG. *4a* in that an intake valve 52 does not valve an air-fuel mixture intake port 54, and thus the mixture intake port 54 is in open communication with an air intake passageway 20 in which air pressure is maintained high. Since, when the intake valve 52 is closed there is a reverse flow of air into air-fuel mixture intake passageway 24, only air is inducted into the cylinder during the initial portion of the intake stroke and relatively large amount of air is charged. The amount of charge of air-fuel mixture can be increased by increasing the cross sectional area of the air-fuel mixture passageway 24 as shown in FIG. *4c*, in order to improve power performance of the engine.

The engine shown in FIGS. *2a* – *2d* and FIGS. *3a* – *3c*; or FIG. *4a* and FIGS. *3a* – *3c*; or FIG. *4b* and FIGS. *3a* – *3c*; or FIG. *4c* and FIGS. *3a* – *3c* has the following advantages.

1. In the engine of the present invention, only air exists in the area disposed adjacent the combustion chamber walls, which area is often referred to as a "quenching zone" since the combustion flame disappears upon coming into contact with the chamber walls that are forcibly cooled. Hydrocarbon deposits on the combustion walls are thus considerably reduced, and the combustion chamber walls and lubricating oil are quite free from dirt. Because of less hydrocarbon deposit cooling the efficiency of the combustion chamber is increased and knocking and run-on will not occur in this engine. It is also found that the $NO_x$ formation during the combustion stroke of this engine is quite low.
2. Low $NO_x$, CO and HC emissions and better fuel economy are accomplished by the engine of the present invention.
3. In the engine of the present invention oxygen which did not make contribution to the combustion is used as an oxidizer to effect afterburning of exhaust gas within exhaust passageway. Thus bare-engine emissions of this engine is quite low.

What is claimed is:

1. In an internal combustion engine a cylinder;

a reciprocating piston in said cylinder;

a cylinder head closing one end of said cylinder, said reciprocating piston and said cylinder head cooperating to form in said cylinder a combustion chamber;

said cylinder head having an air intake port opening directly into said cylinder;

an air intake passageway terminating at said air intake port for admitting air into said cylinder through said air intake port;

said cylinder head having a combustible mixture intake port opening directly into said cylinder, said combustible mixture intake port being disposed in said air intake passageway and radially inwardly of said air intake port;

a combustible mixture intake passageway terminating at said combustible mixture intake port for admitting a combustible mixture into said cylinder through said combustible mixture intake port; and an intake valve having a valve stem and valve head, said intake valve being reciprocable mounted in said cylinder head, said valve head closing said air intake port when said intake valve is in a closed position, said valve head having a portion constructed and arranged so as to be received in said combustible mixture intake passageway to close said combustible mixture intake port until said valve head is spaced from said air intake port by a predetermined amount, said portion of said valve head opening said combustible mixture intake port when said valve head is spaced from said air intake port beyond said predetermined amount, said valve head being positioned when said intake valve is in open positions to direct air from said air intake port toward walls of said cylinder to form an air film in areas adjacent the cylinder walls and a crown of said piston, this air film embracing the combustible mixture after it is emitted from said combustible mixture intake port.

2. The combination as claimed in claim 1, further in combination therewith of: an exhaust passageway terminating in at an exhaust port opening directly into said cylinder and covered by an exhaust valve, said exhaust passageway having means therein for stirring exhaust gases from said cylinder through said exhaust port to promote oxidation of HC and CO contents in the exhaust gases.

3. In an internal combustion engine a cylinder;

a reciprocating piston in said cylinder;

a cylinder head closing one end of said cylinder, said reciprocating piston and said cylinder head cooperating to form in said cylinder a combustion chamber;

said cylinder head having an air intake port opening directly into said cylinder and an exhaust port opening directly into said cylinder;

an air intake passageway terminating at said air intake port for admitting air into said cylinder through said air intake port;

said cylinder head having a combustible mixture intake port opening directly into said cylinder, said combustible mixture intake port being disposed in said air intake passageway and radially inwardly of said air intake port;

a combustible mixture intake passageway terminating at said combustible mixture intake port for admitting a combustible mixture into said cylinder through said combustible mixture intake port;

an intake valve having a valve stem and valve head, said intake valve being reciprocably mounted in said cylinder head, said valve head closing said air intake port when said intake valve is in a closed position, said valve head having a portion constructed and arranged so as to be received in said combustible mixture intake passageway to close said combustible mixture intake port until said valve head is spaced from said air intake port by a predetermined amount, said portion of said valve head opening said combustible mixture intake port when said valve head is spaced from said air intake port beyond said predetermined amount, said valve head being positioned when said intake valve is in open positions to direct air from said air intake port toward walls of said cylinder to form an air film in areas adjacent the cylinder walls and a crown of said piston, the air film embracing the combustible mixture after it is emitted from said combustible mixture intake port;

an exhaust passageway terminating at said exhaust port, said exhaust passageway having means therein for stirring exhaust gases from said cylinder through said exhaust port to promote oxidation of HC and CO contents in the exhaust gases; and an exhaust valve means for closing said exhaust port.

* * * * *